United States Patent [19]

Blackburn et al.

[11] 4,312,762

[45] Jan. 26, 1982

[54] METHOD AND APPARATUS FOR REMOVING SEDIMENT OR OTHER FLOWABLE SOLID MATERIAL FROM A BED UNDERLYING A BODY OF WATER

[76] Inventors: Curtis D. Blackburn, Box 2741, Pikeville, Ky. 41501; Randall L. Blackburn, Box 87; Dewey L. Adkins, Box 317, both of Betsy Layne, Ky. 41605

[21] Appl. No.: 115,220

[22] Filed: Jan. 25, 1980

[51] Int. Cl.[3] ..... E02F 3/88

[52] U.S. Cl. ..... 210/768; 210/170; 210/241; 37/64; 37/189; 37/195

[58] Field of Search ..... 37/64–69, 37/189, 195, 59–61; 210/767, 768, 747, 170, 241, 242.1

[56] References Cited

U.S. PATENT DOCUMENTS

| | | | |
|---|---|---|---|
| 2,950,548 | 8/1960 | Ritscher | 37/67 |
| 3,470,633 | 10/1969 | Soehnlem | 37/67 |
| 3,521,387 | 7/1970 | Degelman | 37/189 X |
| 3,930,324 | 1/1976 | Wightman et al. | 37/189 |
| 4,214,387 | 7/1980 | Boehme et al. | 37/65 X |
| 4,217,212 | 8/1980 | Deal | 37/66 X |

*Primary Examiner*—Thomas G. Wyse

*Attorney, Agent, or Firm*—LeBlanc, Nolan, Shur & Nies

[57] ABSTRACT

This invention relates to a method and apparatus for removing settled sediment from a water-covered bed such as a silt pond. It also relates to a method and apparatus for the transfer of the removed sediment to a disposal site.

18 Claims, 18 Drawing Figures

Fig. 8
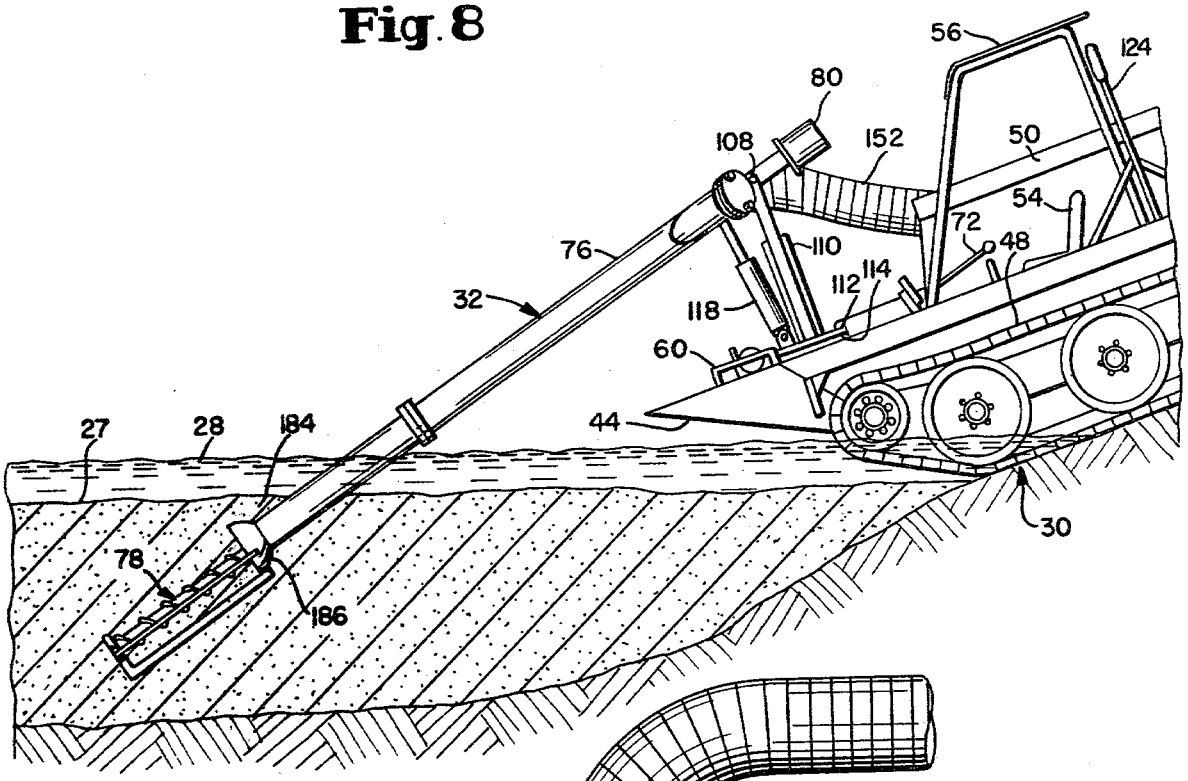
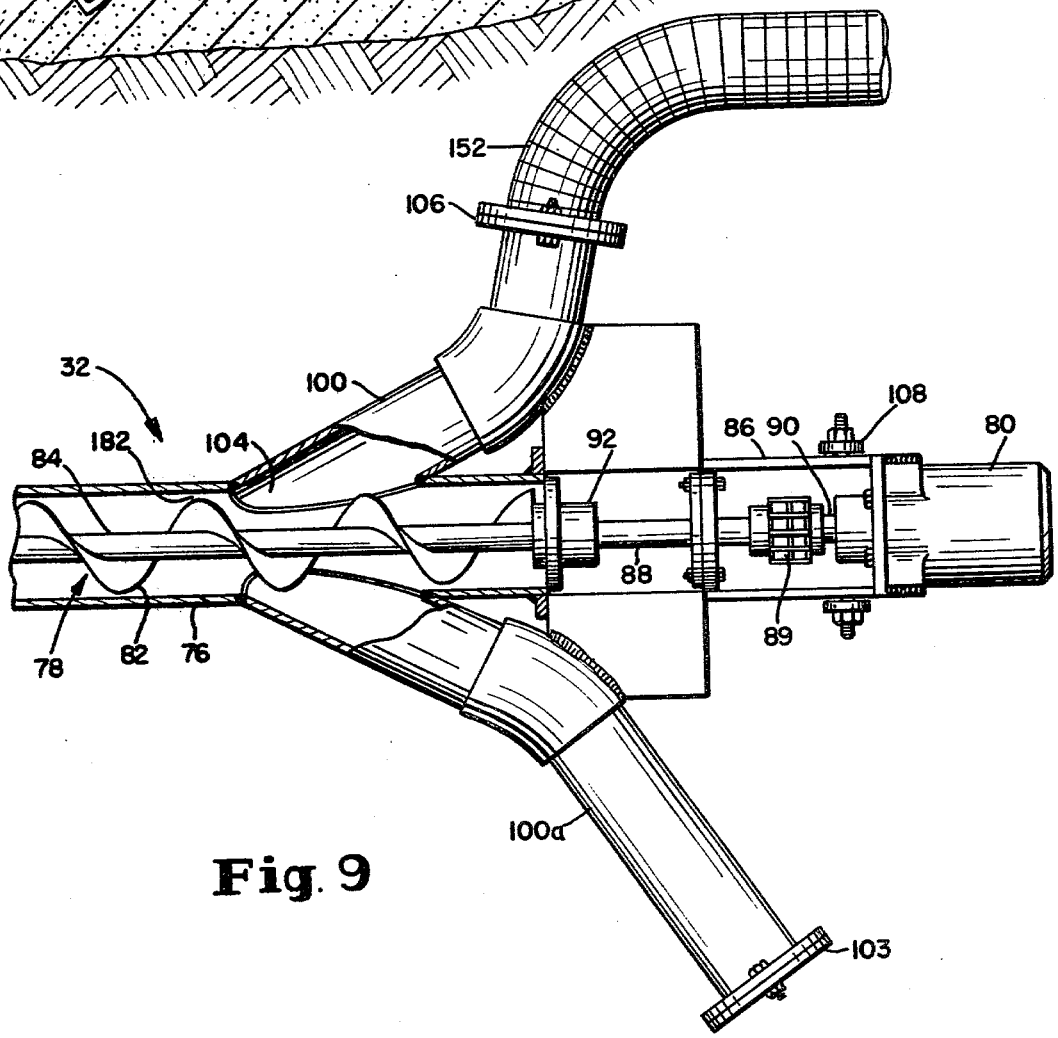
Fig. 9

METHOD AND APPARATUS FOR REMOVING SEDIMENT OR OTHER FLOWABLE SOLID MATERIAL FROM A BED UNDERLYING A BODY OF WATER

FIELD OF INVENTION

This invention relates to a method and apparatus which provides for the removal of settled sediment or other flowable solid material in a water-covered bed and for the transfer of such material to a disposal site.

BACKGROUND

Removal of sediment in silt and settling ponds is one of the more troublesome operations encountered in the coal industry and other industries requiring the use of such ponds. Silt ponds are customarily used in surface mining operations to trap silt entrained or suspended in run-off water flowing down from elevated surface mining sites. Settling ponds, on the other hand, are typically used to trap the effluent from coal washers and preparation plants which operate to extract the impurities in surface-mined and underground-mined coal.

In a surface mining operation, the silt ponds are usually formed by constructing an earth dam or some other kind of dam at an elevation appreciably below the mining site on a mountain or hill. Such silt ponds normally retain the run-off water long enough to permit the silt in the water to settle out to the bottom of the pond before the water is discharged from the pond, thereby allowing cleaner water to discharge through a trickle tube, riser pipe or spillway. Eventually, these ponds become so full of silt that they can no longer retain the water for a sufficient amount of time to allow for the efficient separation of the silt from the water. They therefore require continual cleaning. A similar situation arises with settling ponds.

After the silt is removed from a silt pond in a cleaning operation it must then be disposed of properly, and the ideal disposal site for the removed silt is up the mountain at the surface mining site where the silt originated. Such mining site is usually located at or near the top of the mountain in the form of a strip pit.

At the present time, the customary method of removing and disposing of the silt is to scoop or bucket the silt out of the pond with a dragline bucket, clamshell or backhoe and to place the removed material in a truck which is used to haul the silt from the pond site to the disposal site. Apart from being time-consuming and inefficient, this method of removing and disposing of the silt is costly and gives rise to a number of significant problems.

First, such a bucketing and hauling operation requires the construction of roads to bring in the heavy equipment to be used for cleaning out the pond and, more significantly, to truck out the silt from the pond to the disposal site. The road for hauling the removed silt up the side of the mountain to the mining site is difficult and costly to build, is usually in need of continual repair and quite often is extremely hazardous particularly when the road becomes icy or snow-covered during winter. Furthermore, its construction causes considerable disturbance to the soil and terrain.

Aside from the foregoing, bucketing the silt out of the pond has its significant shortcomings. To begin with, such a removal operation agitates or disturbs the pond, causing a considerable amount of the settled silt to again become suspended or entrained in the water. Furthermore, a considerable amount of the bucketed silt slips through the bucket as it is lifted out of the pond and thus spills back into the pond. Still further, the customary equipment used for removal of the silt is not specifically designed to reach all areas of medium and large sized ponds. Finally, one or more trucks must be on hand to receive the removed silt. In all, a crew of workers and several pieces of equipment are needed to provide for the removal and proper disposal of the silt.

While the foregoing problems plagued the coal industry, there have been numerous proposals spanning many years in the dredging and similar material moving arts. Representative teachings of such proposals appear in U.S. Pat. No. 2,438,637 issued on Mar. 30, 1948 to H. D. Jansen for Combined Conveyor and Excavator, U.S. Pat. No. 2,950,548 issued on Aug. 30, 1960 to K. Ritscher for Ditch Cleaning Machine, U.S. Pat. No. 2,968,879 issued on Jan. 24, 1961 to E. J. Rusich for Mechanical Harvesting Device For Cultivated or Reef Oysters, U.S. Pat. No. 3,470,633 issued on Oct. 7, 1969 to R. M. Soehnlen for Amphibious Dredge, U.S. Pat. No. 3,521,387 issued on July 21, 1970 to N. V. Degelman for Dredging Machine, U.S. Pat. No. 3,148,464 issued on Sept. 15, 1964 to K. M. Jones for Dredging Apparatus, U.S. Pat. No. 3,030,080 issued on Apr. 17, 1962 to M. L. Hise et al. for Apparatus For Removing Discrete Solid Material From A Pit, U.S. Pat. No. 3,050,289 issued on Aug. 21, 1962 to R. V. Gerner for Heavy Hydrocarbon Recovery, etc., U.S. Pat. No 4,052,311 issued on Oct. 4, 1977 to W. F. Martin for Apparatus For Separating Solids From Liquids, U.S. Pat. No. 3,852,384 issued on Dec. 3, 1974 to J. E. Bearden for Liquid Treatment Apparatus, and U.S. Pat. No. 3,865,727 issued on Feb. 11, 1975 to F. W. Broling et al. for Pumping Apparatus With Separating Mechanism.

The foregoing prior proposals are either unsatisfactory or disadvantageous for use in removing and disposing of settled sediment in a silt or settling pond. For example, dredging equipment using suction pumps or the like requires a high water-to-solids ratio and thus withdraws considerable water in the course of removing the solid material. Aside from being inefficient, such a method of removal is unsatisfactory where, as in silt and settling ponds, the amount of water in the pond is relatively small and must be retained in the pond if the settling process is not to be interrupted or degraded by lack of sufficient water. Furthermore, such a suction type dredging technique, like other types of dredging operations using buckets, stirs up and unsettles a large amount of sediment, causing it to again become entrained in the water. Thus, despite the presence of such prior art proposals over the years the coal industry nevertheless has continued to use the problem-plagued bucketing and hauling technique described above for removing and disposing of the silt or other sedimentary matter.

In comparison with the foregoing state of the art, the present invention is capable of more efficiently and more economically removing the sediment from the bottom of the pond without removing any substantial quantity of the water (i.e., the water above the bed) and without disturbing the settled sediment in the bottom of the pond. Moreover, the system embodying the principles of the invention does not required the construction of costly haul roads.

SUMMARY AND OBJECTS OF INVENTION

With the foregoing in mind, the general aim and purpose of this invention is to provide a novel method and apparatus whereby settled sediment or other flowable solid material in silt or settling ponds or other bodies of water is removed and transferred to a disposal site faster, more economically and more efficiently than the prior bucketing or dredging and hauling operation without causing any significant disturbance to the soil or terrain and particularly without requiring the construction of a costly haul road between the pond site and disposal site.

Still another important general object of this invention is to provide a novel apparatus and method which, unlike dredging operations, removes sediment (such as silt) or other flowable solid material from a bed at the bottom of a pond or the like while leaving the water in the pond.

The foregoing objects are generally accomplished according to the subject invention by a unique, vehicle-mounted, material extraction device which is inserted into the sediment bed appreciably below the surface thereof to pick up the sediment from below the bed's surface and to pressure feed the picked-up sediment to a material transfer system without using any suction pumps or the like.

The material transfer system provides for the conveyance of the sediment to the disposal site. It may simply be an on-shore pipe or conduit for relatively short distances between the pond site and the disposal site where the disposal site is below or not at an elevation too far above the pond. For greater distances, especially where the disposal site is at a much higher elevation than the pond site, the material transfer system may also include a booster device such as a force fed or pressure fed pump or a pipe encased material screw conveyor.

The vehicle mounting the material extraction device is preferably of a the power-driven amphibious type specifically adapted for travel over rough terrain and easy maneuverability in relatively shallow ponds such as the silt and settling ponds mentioned above.

The material extraction device comprises a power-driven auger-like helix or spiralled unit longitudinally positioned in a cylindrical casing and havng a lead end of appreciable length extending beyond the open forward end of the casing. The helix unit comprises a shaft-mounted helix or spiralled element.

To place the foregoing system in operation, the on-shore material transfer pipe is laid between the pond site and the disposal site, and a flexible conduit connection is provided intermediate the pipe and the outlet of the material extraction device on the amphibious vehicle to permit the vehicle to be maneuvered in and around the pond without disturbing the position of the on-shore pipe or other on-shore equipment. The amphibious vehicle is then driven into the pond or to a position at the edge of the pond.

The material extraction device is then swung into a downwardly directed position and inserted into the sediment bed underlying the water in the pond advantageously to a depth where the entire length of the exposed lead end of the helix unit and the forward end portion of the cylindrical casing are both immersed in the sediment bed. By rotating the helix unit the exposed lead end of the helix will continuously pick up and thereby extract silt at a level which is spaced below the top surface of the bed to provide for the continuous delivery of the sediment through the casing to the material transfer device mentioned above.

The silt, being mud-like in constituency, will contact and establish a seal or barrier with the immersed forward end of the casing. This seal, as is apparent from the foregoing, lies between the pick-up region of the silt and the water lying above the bed in the pond and is maintained during operation because no suction is applied by any suction pump or the like to withdraw the silt or other sediment in the pond. The seal thus provides a barrier which, during operation, inhibits the passage of water—or at least any substantial amount of water—from the body of water above the bed to the interior of the casing for the helix unit.

Unlike conventional screw conveyors, there is a relatively small clearance between the casing and the helix of the material extraction device, the helix being centrally positioned in the casing during operation. This clearance is purposefully made small enough to make it possible to control the moisture content in the sediment by controlling the rotational speed of the helix unit preferably in a range of rpms which is too low to lift water. The moisture control is important to maintain just enough water in the extracted sediment to keep it pliable and sufficiently lubricated for easy unimpeded flow through the various conduits without creating excessive resistance.

The foregoing apparatus and method of using it is especially advantageous in that it is capable of extracting the sediment with a high solid-to-water ratio (e.g., not more than ten percent water). This high solid-to-water ratio is attainable because of the previously described construction of the material extraction device and the manner of using it.

The high solid-to-water ratio provides a high rate of sediment removal, enabling a large amount of sediment to be removed in a given time period as compared with low solid-to-water ratios, expecially those comparable to and needed for typical dredging operations. Furthermore, the high solid-to-water ratio attainable with this invention has the added advantage of removing the sediment without objectionably depleting the supply of water needed in the pond for continuing the normal settling process.

A booster pump, if required, may be located on shore or on the amphibious vehicle itself, the latter being preferred to provide a self-contained vehicular unit in which the power supply for driving the booster pump, as well as the helix unit, is mounted on the vehicle itself. In one embodiment the power unit for driving the helix unit is separate from the engine which is used to drive the vehicle itself. In another embodiment the engine for powering the vehicle is also used to drive the helix unit, and it may also be employed to power the booster pump if one is used and is placed on the vehicle.

Other features of this invention include the outfitting of the amphibious vehicle with inflatable pontoons to increase the stability and bouyancy of the vehicle in the water.

As compared with the prior bucketing and hauling method and also with various dredging techniques such as those described in the previously identified patents, the method and apparatus of the present invention is faster, more efficient, and more economical. In particular, it eliminates the need for building costly haul roads and for maintaining such roads, as well as eliminating the disturbance of the terrain which is attendant with the construction of such roads. Additionally, this invention has several specific advantages:

It eliminates the need for trucks and drivers for hauling the removed sediment to the disposal site and is operational year round even under icy or other inclement weather conditions;

It enables silt ponds to be located in areas which are not readily accessible by haul roads;

It eliminates the need for costly, large excavating equipment such as dragline buckets;

It can be operated by just one worker, thereby eliminating the need for a crew of workers;

It can be operated to provide the sediment with a high solid-to-water ratio, thus maximizing the amount of removed sediment while minimizing the amount of removed water;

It minimizes the disturbance of the settled sediment in the pond, thus improving the efficiency of the operation; and It affords access to all areas of the pond without difficulty regardless of the size of the pond.

From the foregoing it will be appreciated that other more specific and related objects of this invention reside in the provision of:

(1) a novel, encased auger-like material pick-up device and method of using it;

(2) a novel apparatus and method for controlling the moisture content in the extracted sediment; and (3) a novel amphibious unit which is equipped to extract the sediment from the bed at the bottom of the pond.

Further objects of the invention will appear as the description proceeds in connection with the appended claims and below described drawings.

DESCRIPTION OF DRAWINGS

FIG. 8 is a fragmentary side elevation similar to FIG. 6 but showing the material extraction device in its operating position rather than its stowed position;

FIG. 9 is a longitudinal section of the material extraction device as taken along lines 9—9 of FIG. 8;

DETAILED DESCRIPTION

Although the subject invention is described in the following embodiments as applied to silt ponds, it will be recognized that the principles of this invention may advantageously be used for removing virtually any flowable solid as long as it is of a sufficiently soft or particulate constituency to allow the exposed lead end of the auger-like material pick-up device to penetrate into the material to pick it up. For example, the present invention may be used for removing sediment from a bed in a settling pond.

Figure 1:
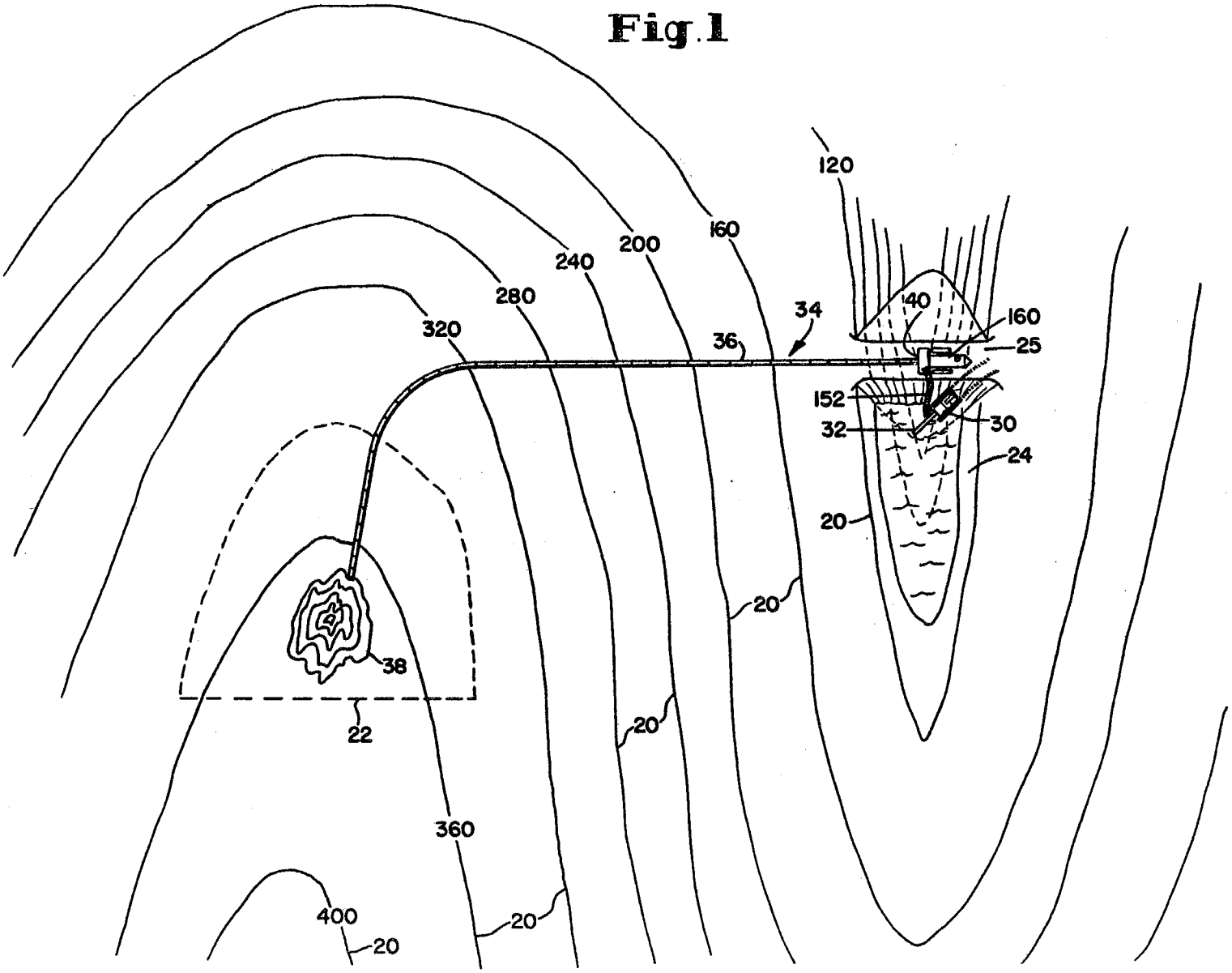
FIG. 1 is a contour map showing in plan the use of this invention for a surface mining site for removing silt from a silt pond and disposing of the removed silt at the surface mining site itself.

One example of a surface mine is shown in plan on the contour map of FIG. 1 where the contour lines are indicated at 20 and are uniformly spaced apart at 40 foot intervals. The elevations at the contour lines are shown in gaps in the lines and extend from about 120 feet to about 400 feet.

In FIG. 1 the coal surface mining site is in the form of a strip pit 22 located near the top of the mountain at an elevation lying between 320 feet and 400 feet. The silt pond for trapping run-off water from the surface mining site is indicated at 24 and lies at an elevation of about 120 foot, approximately 240 feet below the surface mining site 22.

Silt pond 24 is customarily formed by building an earth dam 25 to entrap and temporarily retain run-off water from the surface mining side long enough to allow a good deal of the silt in the water to settle out to the bottom of the pond. The settled silt forms a bed 27 (FIG. 8) underlying the water 28 in the pond. The water, upon rising to a certain level, is discharged from the pond by any suitable means (not shown) such as a trickle tube, riser pipe or spillway at or near the surface of the water.

Figure 2:
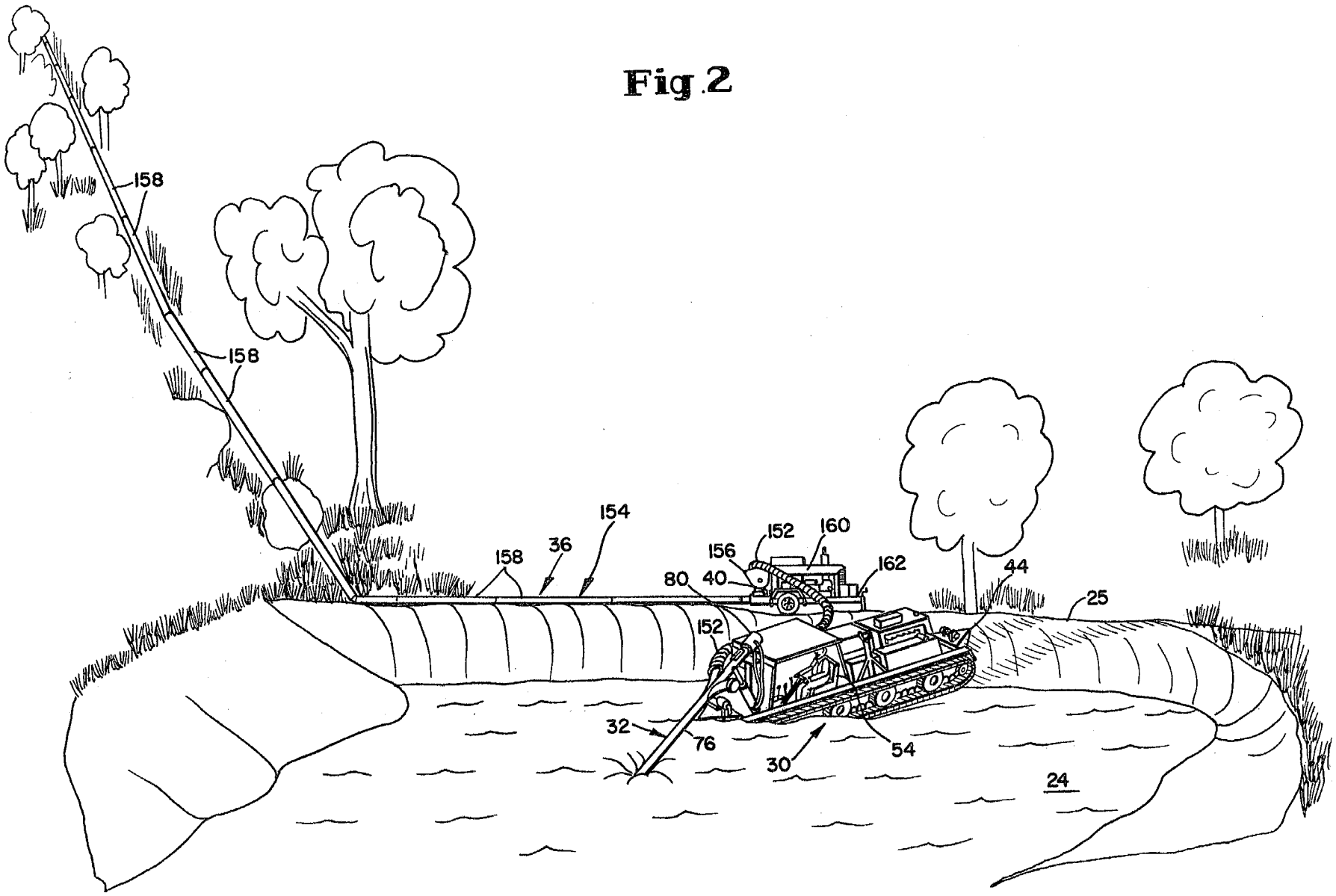
FIG. 2 is a pictorial view of FIG. 1, and illustrates the emplacement of the equipment embodying this invention for extracting the silt from the pond and transferring it up the mountain side for disposal.
Figure 3:
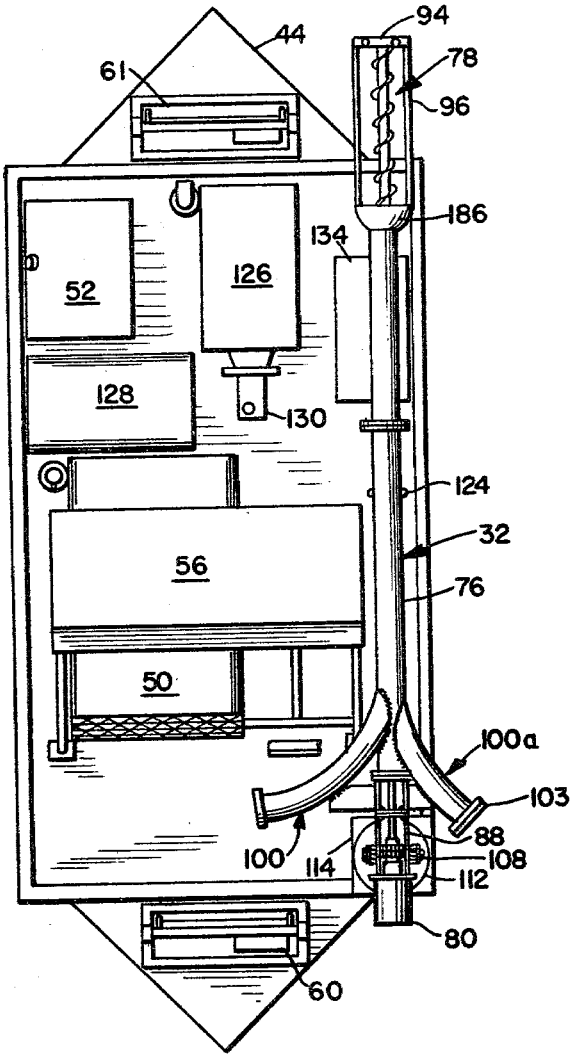
FIG. 3 is a plan view of the amphibious vehicle which is shown in FIGS. 1 and 2 and which is equipped with the material extraction device for extracting sediment from the bed in the pond.
Figure 4:
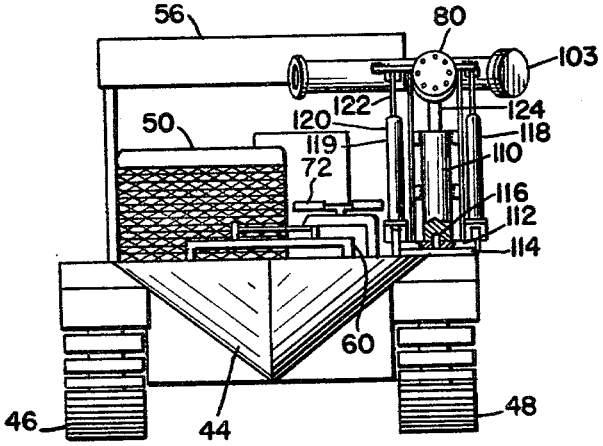
FIG. 4 is a front elevation of the vehicle shown in FIG. 3.
Figure 5:
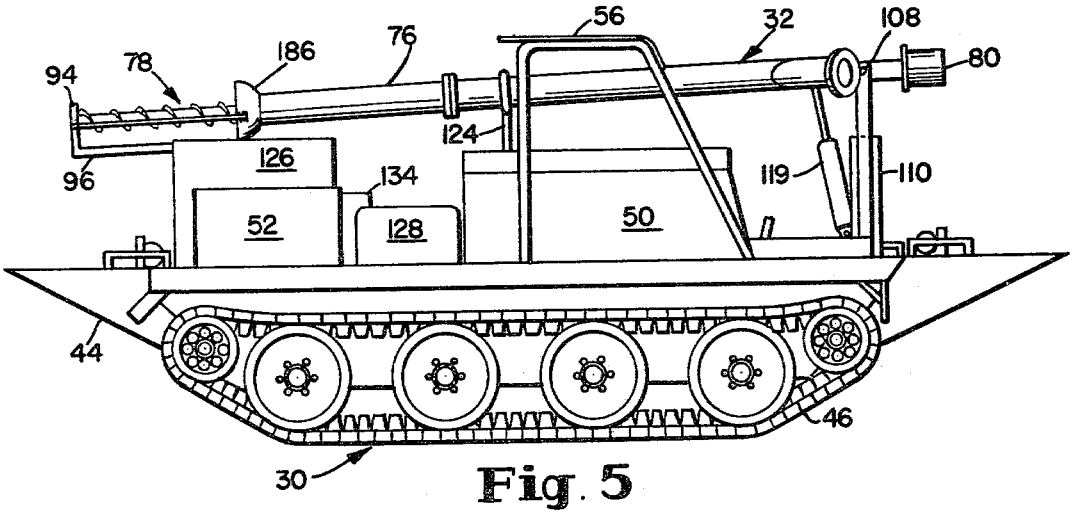
FIG. 5 is a right-hand side elevation of the vehicle shown in FIG. 3.

The apparatus shown in FIGS. 1 and 2 for extracting and disposing of the settled silt in the pond comprises an amphibious vehicle 30, a power-driven material extraction device 32 displaceably mounted on vehicle 30, and a material transfer system 34 (FIG. 2) which comprises a pipeline 36. The extraction device 32, as will be described in detail shortly, provides for the continuous extraction of silt from silt bed 27 and force feeds the extracted silt to pipeline 36. Pipeline 36 provides for the confined passage or conveyance of the extracted silt to an on-shore disposal site which in this example is advantageously located up the mountain at 38 in strip pit 22.

Because of the height that the extracted silt must be lifted to deliver it to the surface mining site in this example, the material transfer system 34 further includes a non-suction type, pressure or gravity fed booster pump 40 which is connected in pipeline 36. In the embodiment illustrated in FIGS. 1–10, pump 40 is located on shore near the edge of pond 24. In another embodiment, to be described later, the booster pump is positioned on vehicle 30 itself.

Figure 6:
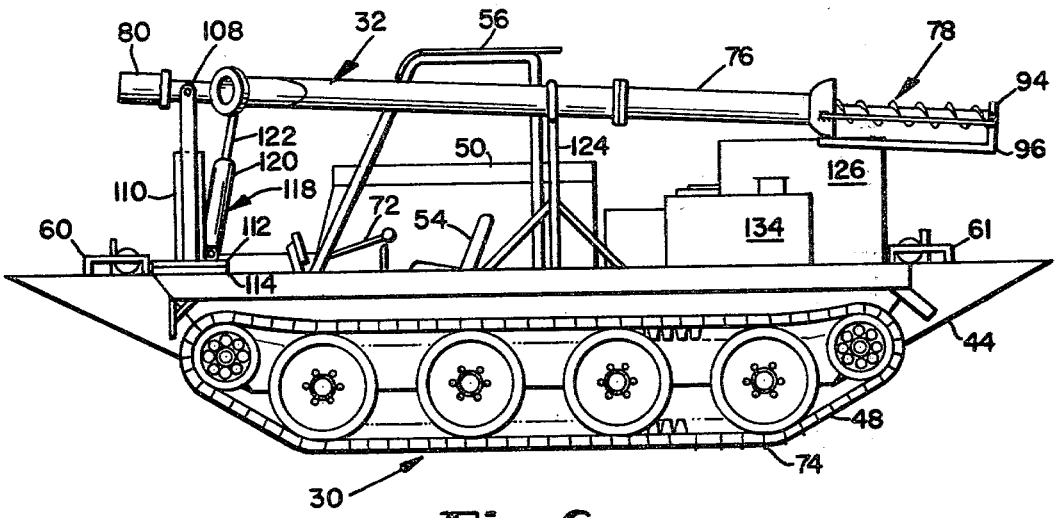
FIG. 6 is a left-hand side elevation of the vehicle shown in FIG. 3.
Figure 7:
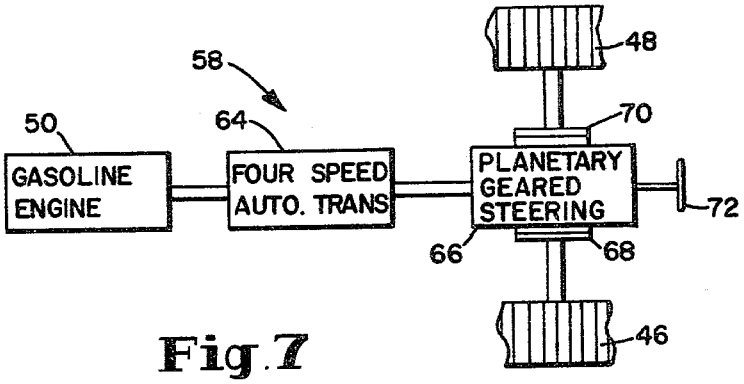
FIG. 7 is a partially schematic diagram showing the power train for the vehicle in FIGS. 3–6.
Figure 10:
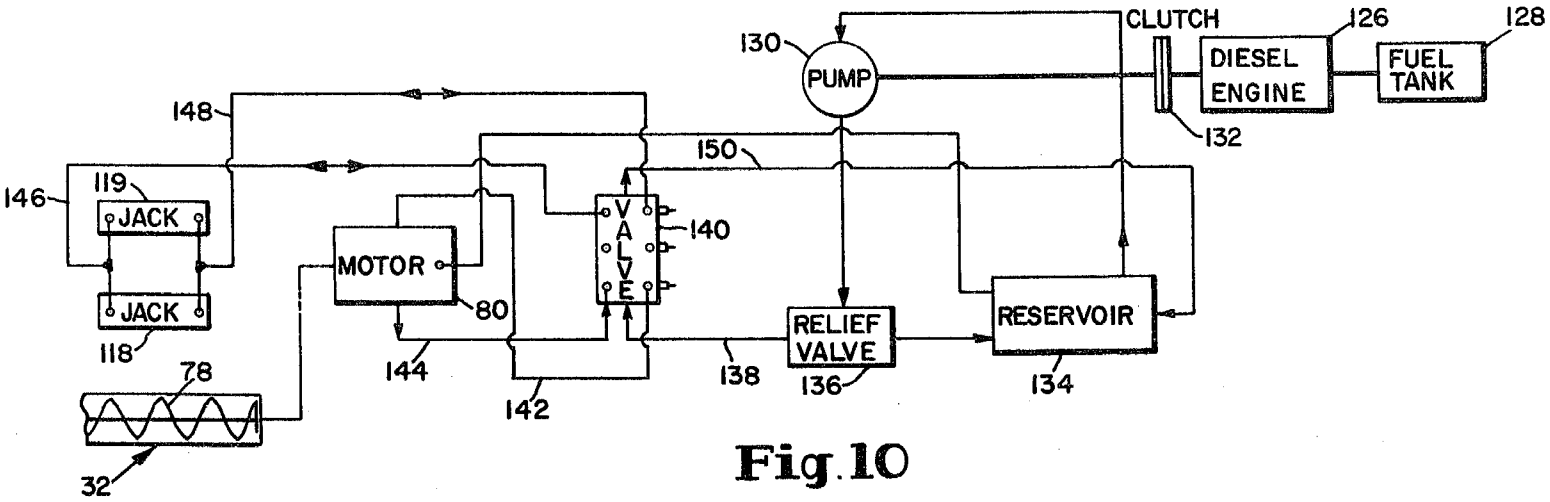
FIG. 10 is a schematic of the power plant and hydraulic circuit for operating the material extraction device and also the hydraulic jacks for swinging the material extraction device about a horizontal axis.

Referring to FIGS. 3–6, the amphibious vehicle 30 may be of any sturdy type suitable for travel over rugged, mountainous terrain and easy maneuverability in and around silt and settling ponds. One example of such a vehicle is the illustrated amphibious track Wood Tiger Cub which is manufactured by Southeastern Equipment Company. Such a vehicle comprises a floatable metal hull 44 and a pair of ground-engaging, endless tracks 46 and 48 mounted exteriorly of hull 44 on opposite sides thereof. Hull 44 is preferably flat-bottomed for travel on silt ponds and other relatively shallow bodies of water. The Wood Tiger Cub is conventionally equipped by the manufacturer with a gasoline tramming engine 50, a fuel tank 52 for engine 50, an operator's seat 54, a canopy 56 providing a protective cover over seat 54, and a power transmission train 58 (FIG. 7). Engine 50, tank 52, seat 54 and power train 58 are all mounted in hull 44 at the locations shown in FIGS. 3–6. Vehicle 30 may also be equipped with a pair of electrically powered winches 60 and 61, one at the bow of the hull and the other at the stern of the hull.

As shown in FIG. 7, the power train 58 comprises an automatic transmission 64, a planetary geared steering unit 66 and a pair of clutches 68 and 70. The automatic transmission 64 may be of the four speed type and drive connects engine 50 to steering unit 66. Steering unit 66 has two outputs, one drive connected through clutch 68 to track 46 and the other drive connected through clutch 70 to track 48. Steering unit 66 is provided with a hand-manipulatable steering control member 72 which is used to selectively control operation of clutches 68 and 70 for steering along a straight path, to the left and to the right in a conventional manner.

Tracks 46 and 48 are each provided with the usual belt-mounted grouters 74 for advancing the vehicle over the ground and also for propelling the vehicle through the water.

As best shown in FIG. 9, the material extraction device 32 comprises a hollow metal cylindrical casing 76, an auger-like helix unit 78 and a reversible, variable speed hydraulic motor 80. Helix unit 78 is longitudinally positioned in casing 76 and comprises a metal helix or spiral element 82 circumferentially wound around and fixed to a straight, rigid hollow support shaft 84. The longtitudinal axes of helix 82 and shaft 84 are coincident. Helix unit 78 is coaxial with casing 76.

Motor 80 is mounted on a rigid metal frame 86 which is fixed to and extends rearwardly from the rear end of casing 76. The rearward end of the helix-mounting support shaft 82 is non-rotatably secured to and supported by an intermediate shaft 88. Shaft 88 extends through an opening in the rearward end of casing 76 and non-rotatably coupled by a sprocket chain coupling 89 or other suitable means to the output shaft 90 of motor 80. The rotational axes of shafts 84, 88 and 90 are axially aligned. A bearing and seal assembly 92 is provided in the rearward end of casing 76 to journal shaft 88 and to provide a seal which prevents extracted material in casing 76 from leaking through the rearward end of the casing. The bearing in assembly 92 may be of the tapered roller thrust bearing type.

As shown, the lead end portion of helix unit 78 projects through the forward open inlet end of casing 76 and extends beyond the forward end of casing 76 by an appreciable length. In this embodiment the forward end of the helix-supporting shaft 84 is journalled in a bearing 94 which is mounted on an open frame or framework 96. Frame 96 is fixed to and extends forwardly from the forward end of casing 76. The construction and arrangement parts are such that the lead end portion of helix unit 78 completely exposed for insertion into silt bed 27.

Casing 76 is provided with a side outlet tube 100 adjacent to its rearward end. Helix unit 78 extends between and beyond the inlet and outlet ends of the casing. As shown, in FIG. 9, outlet 100 is welded to casing 76 in registry with the casing's side outlet port 104 and is provided with a bend so that it extends at an acute angle with respect to the casing's longitudinal axis. Outlet 100 terminates in a flanged outlet port 106 which opens generally laterally with respect to casing 76.

For convenience, a second side outlet tube 100*a* may be located on the side of casing 76 opposite from outlet 100. Outlet 100*a* is the same as outlet 100. It will be appreciated that only one outlet is used at any given time, the unused one being blocked off by any suitable means such as a blank 103.

Casing 76, which supports the other parts of the material extraction device 32, is pivotally mounted by a horizontal pivot 108 on the upper end of a rigid, upstanding post or structural support frame 110. The material extraction device 32 is therefore swingable or pivotable about the horizontal axis of pivot 108.

Frame 110 is supported on hull 44 and has a base plate 112 seated on a pad 114. Pad 114 is fixed to hull 44. The lower end of frame 110 at base plate 112 rotatably receives a hollow post or pipe 116 which is fixed to and extends upwardly from pad 114 such that the complete assembly of frame 110 and material extraction device 32 is rotatable on pad 114 about the vertical axis of post 116. By this construction the material extraction device 32 is horizontally swingable through an angle in excess of 180 degrees and approaching 360 degrees.

As shown in FIGS. 3–6 and 8 a pair of parallel hydraulic jacks 118, 119 are used to swing the material extraction device 32 about the horizontal pivot axis of pivot 108. Each of the jacks 118, 119 comprises a cylinder 120 pivotally secured to base plate 112 and a piston rod 122 pivotally secured to casing 76 at a point longitudinally spaced forwardly of pivot 108. Jacks 118, 119 are therefore mounted for rotation with frame 110 and extraction device 32 about the vertical axis of the hollow post 116.

By the foregoing construction, extraction device 32 is swingable between a stowed position (FIGS. 3–6) and a selected operating position such as the one shown in FIGS. 2 and 9 where the extraction device extends forwardly of vehicle 30. Alternatively, extraction device 32 may be swung through a lesser horizontal angle to an operating position where it extends laterally or generally laterally from vehicle 30. It will be appreciated that the operating position may lie within a wide range of angles from the stowed position.

In its stowed position extraction device 32 extends horizontally rearwardly from the bow of hull 44 where the exposed lead end portion of helix 82 lies near the stern of the hull. In this position a saddle 124 fixed to hull 44 receives casing 76 to support the extraction device 32 as best shown in FIG. 6.

To move extraction device 32 to a material pick-up operating position jacks 118, 119 are first operated in unison to pivot the extraction device 32 upwardly about the horizontal axis of pivot 108 to a position where it clears saddle 124. The complete assembly of extraction device 32, frame 110 and jacks 118, 119 is then manually rotated about the vertical axis of post 116 to a position where extraction device 32 extends beyond vehicle 30 above the region where silt is to be removed. Jacks 118 and 119 are then operated in unison to swing extraction device 32 downwardly about the horizontal axis of pivot 108 to the ultimate operation position (such as the one shown in FIG. 8) where the exposed lead end portion of helix unit 78 is inserted into the silt bed 27 to a depth where the exposed lead end of helix unit 78 and preferably the forward nose portion of casing 76 are embedded or buried in silt bed 27. To return extraction device 32 to its stowed position, the extraction device is pivoted upwardly, then swung horizontally rearwardly and finally pivoted downwardly to the position where it rests on saddle 124.

Referring to FIGS. 3–6, 8 and 10 the power for operating extraction device 32 and jacks 118, 119 originates from a suitable power plant such as a diesel engine 126. Fuel for engine 126 is stored in a tank 128. Engine 126 is drive connected through a manually operated clutch 132 to a hydraulic pump 130 which is supplied with hydraulic fluid from a reservoir 134. Pump 130 may be of any suitable type and preferably is of the variable displacement type in which the volume of pumped fluid is varied while maintaining the pump discharge pressure constant to provide a variable speed drive for motor 80 and jacks 118, 119.

Pump 130 feeds hydraulic fluid under pressure through a relief valve 136 and a hose 138 to an inlet port of a conventional multi-port valve 140. If the pump discharge pressure becomes excessive relief valve 136 will operate to vent the hydraulic fluid back to reservoir 134. A first hose 142 connects one port of valve 140 to one of the operating ports of motor 80, and a second hose 144 connects another port of valve 140 to the other operating port of motor 80. These connections permit hydraulic fluid under pressure to be fed in opposite directions through motor 80, thus enabling the motor to be selectively driven in opposite directions by operation of valve 140.

Valve 140 also has separate ports for feeding hydraulic fluid under pressure through one hose 146 to extend jacks 118 and 119 and through another hose 148 to retract the jacks. Valve 140 has a control member (not shown) which provides for the manual operation of valve 140 for driving motor 80 in either direction without operating jacks 118, 119 and extending and retracting jacks 118, 119 without operating motor 80.

For operating motor 80 hydraulic fluid under pressure is fed through one of the two hoses 142, 144 and will be returned to valve 140 by way of the other of the two hoses 142, 144. The direction in which motor 80 is driven by the hydraulic fluid is determined by the direction in which fluid is fed through the motor, and the direction of hydraulic fluid flow through the motor is controlled by valve 140. The speed of motor 80 and hence of helix unit 78 is controlled by varying the output (displacement) of pump 130.

Jacks 118 and 119 are operated by feeding hydraulic fluid under pressure through one of the two hoses 146, 148 and returning hydraulic fluid through the other of the two hoses 146, 148. Hydraulic fluid returned to valve 140 is returned through a further hose 150 to reservoir 134.

Referring back to FIG. 2, the pipeline 36 has two portions 152 and 154. Portion 152 is a relatively long flexible hose or conduit which is secured at one end to the flanged outlet 106 of casing 76 for feeding extracted silt from casing 76 to a support hopper or bin 156 for pump 40. Supply bin 156 is located along with pump 40 near or adjacent to the edge of pond 24.

The other portion of pipeline 36, namely portion 154, may be of the sectionalized type having a multiplicity of rigid, interconnected pipe sections 158 laid end-to-end and bolted together for passing the silt from pump 40 up the steep side of the mountain to the disposal location 38 at the surface mining site 22. Pipe sections 158 may be laid on the ground surface as shown. Alternatively, they may be buried or partially buried in the ground to keep them from being moved about. With this invention the distance and elevation of the disposal site from the pond poses no problem, and the pipeline portion 154, which is sectionalized to provide a variable length, may be laid over virtually any terrain, even locations that are impassable by vehicles.

Pump 40 is gravity fed by the silt delivered to hopper 156 and is driven in this embodiment by a gasoline engine 160 or other suitable type of prime mover. Engine 160, pump 40 and supply hopper 156 may all be mounted on a two wheeled trailer 162 which can be hauled to a selected location for operation with the amphibious vehicle 30.

The supply hopper 156 for pump 40 may be eliminated by matching the material transfer or feed rates of the material extraction device 32 and pump 40. It will be appreciated that pump 40 is a pressurizing device, not a suction device. For example, it may be a pressure or gravity fed concrete pump or mud pump.

When the equipment thus far described is set up for operation the sectionalized pipe portion 154 is kept stationary and the flexible pipe portion 152, which is connected intermediate pipe portion 154 and the material extraction device 32 on vehicle 30, permits vehicle 30 to be maneuvered about without disturbing the position of either pipe portion 154 or trailer 162. Usually, the sections 158 of pipe portion 154 are laid along the most direct route between the silt pond and the disposal site 38 at or near the top of the mountain. Such a route is frequently up a very steeply sloped side of a mountain as shown, for example, in FIG. 2.

To place the equipment thus far described in operation vehicle 30 is driven to the location at the edge or in the silt ponds 24, and extraction device 32 is swung to an operating position where the exposed lead end of helix unit 78 as well as thenose portion of casing 76 are immersed or buried in the silt. Clutch 132 is then engaged to impart rotation to helix unit 78.

Rotation of helix unit 78 picks up or extracts the silt from silt bed 27 and feeds it through casing 76 and the flexible pipeline portion 152 to hopper 156. From hopper 156 the extracted silt is pressure fed through the sectionalized pipeline portion 154 to pump 40 to the disposal location at the surface mining site 22. It therefore will be appreciated that the silt in silt bed 27 is continuously extracted and pressure fed to the transfer system comprising pipeline 36 which in turn continuously transfers the extracted silt to the disposal location concomitantly with the continuous extraction of silt from the bed by extraction device 32.

In place of pump 40 a sectional screw conveyor 170 (see FIG. 11) may be utilized for transferring the extracted silt from an on-shore transfer point to the disposal site. Such screw conveyor 170 comprises a multiplicity of individual screw conveyor sections 172 mounted one in each of the pipe sections 158. Each screw conveyor section 172 is rotatably supported in its individual pipe section 158 by bearings 174. The screw conveyor sections 172 are non-rotatably coupled together at adjacent ends by couplings 176 to thus provide a unitary screw conveyor system extending through pipe portion 154.

Figure 11:
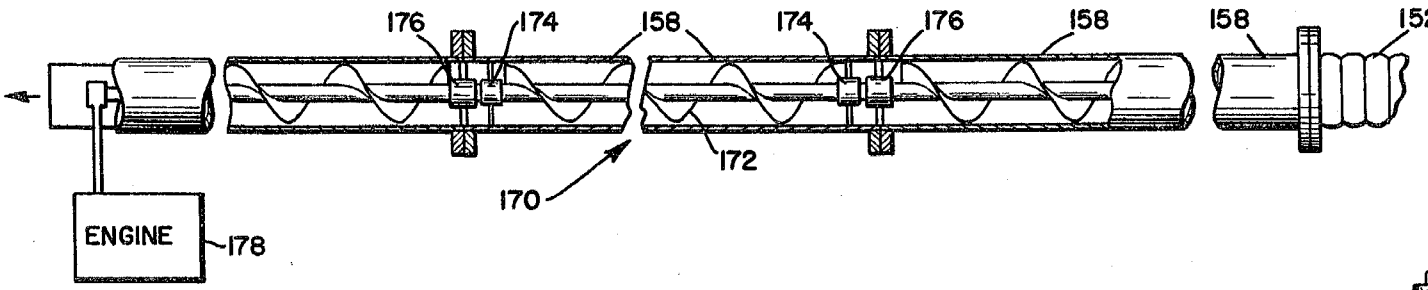
FIG. 11 is a fragmentary longitudinal section of a secondary material transfer conveyor system for use in place of the booster pump shown in FIGS. 1 and 2.

Screw conveyor 170 may be driven by any suitable prime mover such as a portable gasoline engine 178. Engine 178 may be drive connected to screw conveyor 170 at any desired location along the length of the screw conveyor for imparting rotation to the screw conveyor in pipeline portion 154. For example, it may be drive connected to the discharge end of screw conveyor 172 at the disposal site as shown in FIG. 11. Alternatively it may be drive connected to intake end of the screw conveyor at the silt pond site.

With the illustrated arrangement it will be appreciated that the material extraction device 32 lifts the silt from the silt bed and pressure feeds it through casing 76 to screw conveyor 170. Screw conveyor 170 in turn feeds the extracted silt through pipeline portion 154 to the disposal site.

As compared with a typical dredging operation, the material extraction device 32 of the invention is constructed and used in such a way that, rather than picking up material in a slurry from the surface of the silt bed, it extracts or picks up the silt from a region which is spaced below the upper surface of silt bed 27. This is accomplished by inserting the material extraction device 32 into the silt bed 27 to a sufficient depth where the exposed lead end of helix unit 78 and preferably the forward nose end portion of casing 76 is immersed or buried in the silt bed below the surface of the bed. In such an operating position the longitudinal axis of extraction device 32, rather than lying flat, extends normal or at an acute angle relative to the bed so that the lead end of helix unit 78 extends endwise in the silt bed. For such an operating position it will be appreciated that the lower portion of the material extraction device 32, including the exposed lead end of helix unit 78, lies below the surface of silt bed 27 while the upper portion of extraction device 32 lies above the silt bed 27 as shown, for example, in FIG. 8. It is noteworthy to observe that the material extraction device 32 will lift silt or other material from a water-covered bed in a vertical position or at any acute angle between the vertical position and a location approaching flat horizontal position.

By inserting the material extraction device 32 at least to a depth where the forward end of casing 76 is immersed or buried in silt bed 27, the silt in the bed will peripherally surround and cling to the casing to form a seal (indicated at 184 in FIG. 8) that prevents or inhibits water in the pond from being drawn into the interior of casing 76 along with the extracted silt. It is important to observe that this seal lies between the body of water 28 in the pond and the region where the exposed lead end of helix unit 78 picks up the silt below the surface of the silt bed 27. Seal 184 is maintained during operation because no suction or vacuum pumps or the like are used for lifting the silt from the silt bed 27.

Thus, seal 184 provides a barrier between the water in the pond and the region where the silt is picked up below the surface of the bed. This barrier may be enhanced by outwardly flaring the open inlet end of casing 76 to form a bell-like or disc shaped end 186 of substantially larger diameter than the remainder of casing 76. Portion 186 is preferably completely immersed or buried in the silt bed 27 below the surface thereof so that any water seeping down from along the region of the outer periphery of casing 76 will be deflected outwardly by portion 186 and hence away from the open inlet end of casing 76. Except for the enlarged diametered end portion 186, the internal diameter of casing 76 is uniform.

According to an important feature of this invention, the material extraction device 32 is so constructed that it is capable of controlling the moisture of water content in and hence the density of the extracted silt or other material. This is mainly accomplished by selection of the pitch for helix 82 and by providing a sufficiently small radial clearance (indicated at 182 in FIG. 9) between helix 82 and casing 76 such that the moisture content can be controlled simply by varying the rotational speed of the helix unit 78. Other factors having an effect upon the moisture content in the picked-up material are the depth to which helix unit 78 is inserted into the silt bed 27, the diameter of helix 82, the length of the exposed lead end of helix unit 78 extending beyond casing 76, and the back pressure tending to oppose the movement of the material through casing 76. It will be noted that helix 82 continuously seats against shaft 84 throughout its length similar to the construction of an auger so that there is no open space between helix 82 and shaft 84.

For picking up silt from a silt bed in a silt pond it is preferred for efficient and economical operation that the moisture content in the picked-up material be kept at a low value which is just high enough to provide sufficient lubrication for low-resistance, unimpeded flow of the silt through casing 76 and pipeline 36.

If the clearance 182 is too large the moisture content in the extracted material cannot be controlled satisfactorily because the compression of extracted material on the flights 180 of helix 82 will be impaired. However, by reducing the clearance 182 to a sufficiently small value and by inserting the exposed lead end of helix unit 78 completely into the silt bed, the material lifted by the exposed end of helix unit 78 will completely fill casing 76 and will thereby be compressed on the flights 180 and also against the interior of casing 76 to enable the moisture content to be precisely controlled over a wide range by varying the rpm of helix unit 78.

Furthermore, by making clearance 182 sufficiently small, helix unit 78 may be operated in an rpm range that is too low to lift water per se, thus further enhancing the control over the moisture content in the extracted material. According to the apparatus of this invention, therefore, the moisture content can be controlled to such an extent that the constituency of the removed silt or other sediment will be a moist, pliable, pasty-like mass rather than a slurry-like mass which is dredged up by conventional dredging equipment.

Because of the construction described above the material extraction device 32 is capable of lifting solid material in which the amount of water by weight ranges from as low as 3% to as high as almost 100%. For efficient and economical removal of sediment from silt and settling ponds, the amount of moisture or water by weight in the extracted material should be less than 10% and is preferably about 5%. This is well within the control range of the material extracting device of this invention.

Decreasing the rotational speed or rpm of the helix unit 78 decreases the moisture content in the extracted material. Conversely, increasing the rotational speed, increases the moisture content in the extracted material.

Increasing the pitch of the helix 82 has the effect of compressing the extracted material more because a larger amount of material is then moved between pitches or flights of the helix 82. Increasing the amount of material moved through the casing in turn increases the resistance of movement of the material through the casing. Consequently, increasing the pitch of the helix 82 makes the material less denser. Conversely, decreasing the pitch of helix 82 increases the density of the extracted material.

To obtain a desired water content in the material extracted a helix unit with an appropriate pitch may first be selected. Then, during operation, the rotational speed of helix unit 78 is adjusted to establish the desired moisture content within the available adjustment range.

The selection of the various parameters affecting the moisture content depends on the characteristics and/or constituency of the material to be removed.

One suitable set of parameters for removing silt from a silt pond is as follows:

Clearance 182: 1/16 inch
Pitch of helix 82: 3 inches
Length of exposed lead end of helix 82 extending beyond casing 76: 2 ft.
Diameter of helix 82: 5 15/16 inches
Rotational Speed of helix unit 78: 1800 rpm
Diameter of shaft 84: 2⅜ inches
Length of helix unit 78: 9 ft.
Casing 76: 6 inch sch. 40 std. pipe It will be appreciated that the capacity of the material extraction machine (i.e., the amount of material moved in a given time period) depends upon the pitch and diameter of helix 82 and the rotational speed of helix unit 78. It also will be noted that the pitch itself does not necessarily have to be uniform throughout the full length of helix unit 78. It also will be noted that the sediment lying in silt bed 27 is engaged directly by the exposed lead end of helix unit 78 which lifts it through casing 76 and force feeds it through the flexible pipeline portion 152 to an on-shore transfer point where it is then conveyed up the side of the mountain to the disposal site.

It further will be appreciated that the length of the exposed lead end of helix unit 78 immersed in the silt bed also has a bearing on the amount of material picked up. The smaller the exposed length the less material is picked up. Therefore, the exposed length of helix unit 78 must be substantial for achieving satisfactory operation.

The apparatus described above is capable of moving at least 70 cubic yards of silt per hour. It even can move as much as 80 to 90 cubic yards per hour.

The material extraction device 32 is capable of pushing silt or similar sediment as far as 200 feet. Thus, for distances within the range of the material extraction device booster devices such as pump 40 and screw conveyor 170 may be eliminated and the sediment or other material may be delivered to the disposal site solely by operation of device 32.

FIGS. 12–18 illustrate in another embodiment of this invention which, among other things, provides a modified construction for supporting and driving the material extraction device. To the extent that the embodiment of FIGS. 12–18 is the same as the first embodiment, like reference numerals have been applied to designate like parts.

Figure 12:
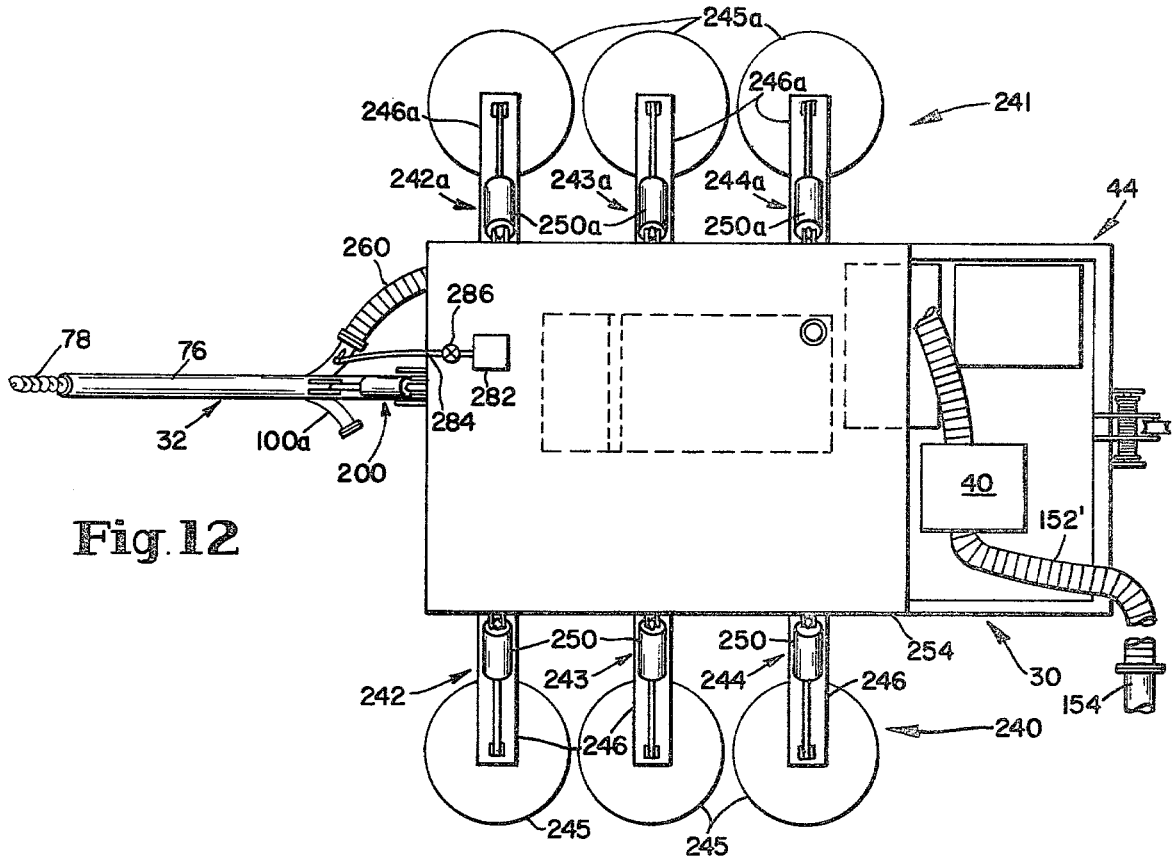
FIG. 12 is a plan view of the amphibious vehicle according to another embodiment of this invention.
Figure 13:
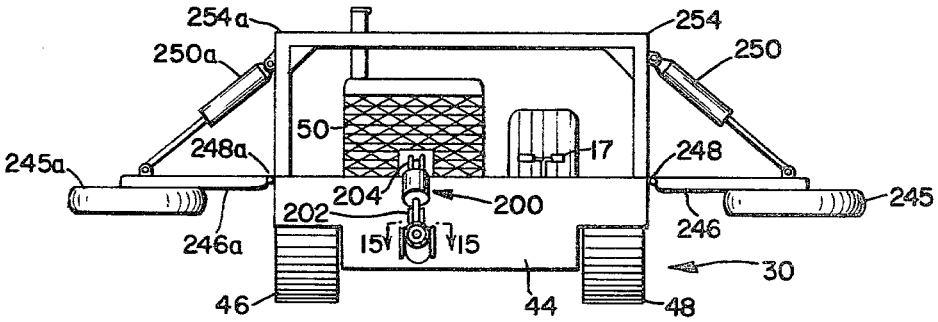
FIG. 13 is a front elevation of the amphibious vehicle shown in FIG. 12.

In the embodiment shown in FIGS. 12–17 the material extraction device 32 is suspended from a hydraulic jack 200 at a position where it extends longitudinally forwardly of the vehicle. One end of hydraulic jack 200, such as the operating piston rod end, is pivotally secured at 202 to the casing 76 of device 32. The opposite end of hydraulic jack 200 is pivotally secured at 204 to hull 44. Jack 200 is disposed above extraction device 32 and extends at acute angle with respect to a horizontal plane and also with respect to the longitudinal axis of extraction device 32. The support is such that extraction device 32 is spaced forwardly of the bow of vehicle 30 as best shown in FIG. 13. Extraction device 32 may be laterally offset to one side of a vertical plane medially intersecting vehicle 30 as best shown in FIG. 13.

Figure 15:
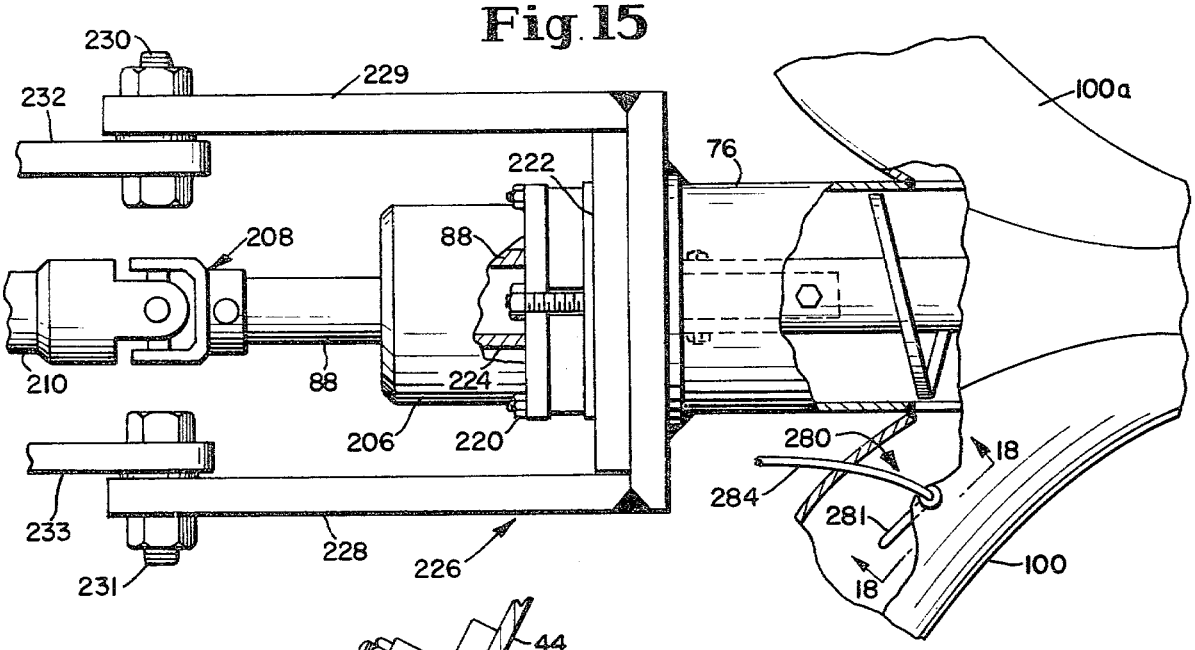
FIG. 15 is an enlarged fragmentary plan view of the material extraction device and the drive for the helix unit of FIGS. 12–14, portions of the casing parts being broken away to illustrate interior details.
Figure 16:
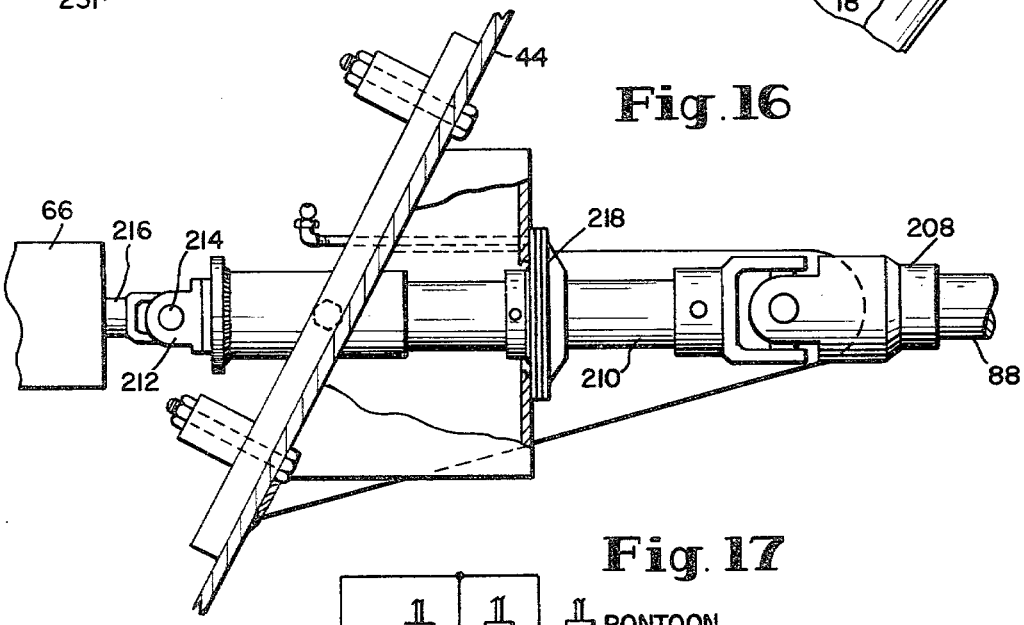
FIG. 16 is a partially sectioned side elevation of the construction shown in FIG. 15.

Referring to FIGS. 15 and 16, the intermediate shaft 88 extends through the rear end of casing 76 and through a bearing and seal housing 206. At its rearward end beyond housing 206 shaft 88 is coupled by a universal joint 208 to a drive shaft 210. Drive shaft 210 extends through an aperture in the bow of hull 44 and terminates within hull 44 in a shear pin coupling member 212. A removable shear pin 214 provides a drive connection between coupling member 212 and the complementary coupling end on a drive 216 of steering unit 66. Shaft 216 is driven by engine 50 through the automatic transmission 64 and gearing in steering unit 66. A seal and bearing unit 218 peripherally surrounding shaft 210 provides a water-tight seal to prevent leakage of water into hull 44 at the location where shaft 210 extends through the hull.

From the foregoing description it will be appreciated that the universal joint 208 is located exteriorly and forwardly of hull 44. Housing 206 is fixed by bolt and nut assemblies 220 to a flange 222 at the rear of housing 76. Mounted in housing 206 is a seal and radial and thrust tapered roller bearing unit 224. Unit 224 receives shaft 88 to support the shaft and to provide a seal which prevents leakage of extracted sediment out of the casing.

Still referring to FIG. 15, a support bracket 226 is secured to the flange 222 of casing 76 and has a pair of spaced rearwardly extending arms 228 and 229 receiving support rods 230 and 231. Rods 230 and 231 are axially aligned and are received in ears 232 and 233, respectively. Ears 232 and 233 are fixed to hull 44. By this construction, the material extraction device 32, which includes casing 76, is supported for pivotable or swinging displacement about the aligned horizontal axes of rods 230 and 231, such axes extending normal to the longitudinal axis of vehicle 30.

In the embodiment shown in FIGS. 12–18, only one mechanical or structure radial support bearing, namely bearing unit 224, is used to support helix unit 78, there being no radial support bearings for helix unit 78 at the forward end of the helix unit. Helix unit 78 is therefore supported in casing 76 in cantilever fashion by bearing unit 224 when casing 76 is not filled with sediment or other material during operation. Under such condition, helix unit 78 rests on the interior of casing 76 at the forward open end of the casing. However, when extracted sediment or other material is fed through casing 76 to fill the casing during a material extraction operation, the material itself will act as an additional radial support bearing for helix unit 78 to keep helix unit 78 centered in casing 76 in alignment with the casing and hence at a position where clearance 182 is uniform. By this construction it will be appreciated that the need for a second support bearing, as in the case of the first described embodiment, is eliminated.

For the embodiment shown in FIGS. 12–18, it will be appreciated that the material extraction device 32 is mounted for swinging movement about a horizontal axis at the bow or forward end of vehicle 30. Jack 200 is selectively operable to swing extraction device 32 in a vertical plane between a raised non-operating position and a lowered operating position. In its raised position extraction device 32 extends upwardly at an acute angle with respect to a horizontal plane. In its lowered position, extraction device 32 extends downwardly at such a variable acute angle that the exposed end of helix unit 78 and the forward end of casing 76 may be immersed or buried on the bed of sediment for effecting the extraction and hence removal of the sediment.

The vehicle in the embodiment of FIGS. 12–18 may advantageously be equipped with a pair of inflatable pontoon assemblies 240 and 241. Pontoon assemblies 240 and 241 are located on opposite sides of hull 44 and are used to furnish additional bouyancy and stability for vehicle 30.

Figure 14:
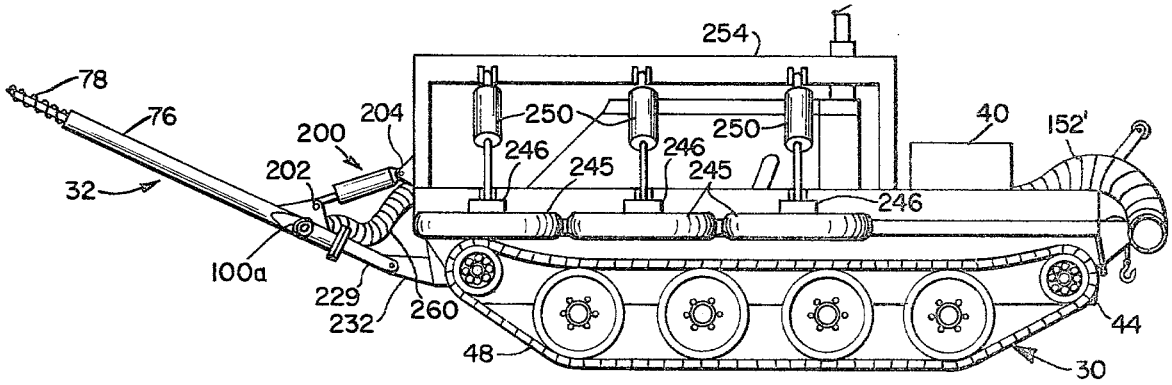
FIG. 14 is a left-hand side elevation of the amphibious vehicle shown in FIGS. 12 and 13.

As shown in FIGS. 12–14 pontoon assembly 240 may be of suitable construction and in this example is shown to have three hydraulically operated units 242, 243 and 244. Each unit 242–244 comprises an inflatable pontoon 245, a support frame 246 and a hydraulic jack. Pontoon 245 is secured to frame 246, and frame 246 is pivotally secured at 248 to the side of hull 44. A hydraulic jack 250 is pivotally secured to frame 246 and to a further frame 254 which is mounted on hull 44.

The jack 250 in each unit 242–244 is operable to swing its associated pontoon 245 about the horizontal pivot axis of pivot 248 between a raised inoperative or stowed position and a lowered, operative position. In its lowered position the assembly of frame 246 and pontoon 245 in each unit 242–244 extends horizontally such that the pontoon, upon inflation, floats in the water to provide vehicle 30 with additional bouyancy and stability.

The inflatable pontoon assembly 241 is the same as pontoon assembly 240. Accordingly like reference numerals suffixed by the letter "a" have been applied to designate the corresponding parts of assembly 241.

In the embodiment shown in FIGS. 12–18, pump 40, rather than being located on shore, is mounted in hull 44 (see FIG. 12), thus making vehicle 30 a complete self-contained unit in the sense that there is no on-shore equipment needed except for the pipeline portion 154.

As shown in FIG. 12, the outlet 100 of the extraction device 32 may be connected directly to the inlet of pump 40 by a suitable conduit or pipe 260. Conduit 260 may be flexible as shown. The output of pump 40 is connected to pipeline portion 154 by a flexible pipe or conduit 152'. Pipe 152' corresponds to the pipeline portion 152 and enables vehicle 30 to be maneuvered about without disturbing the position of pipeline portion 154.

In this second embodiment the material transfer rate of pump 40 is matched with that of extraction device 32, thus eliminating the need for hopper 156. It will be appreciated that if pump 40 is not required for a given operation, it may be by-passed by connecting the flexible pipeline 152' directly to either outlet 100 or outlet **100*a*. Furthermore, pump 40** may be driven by a variable speed drive to enable selective variation of the pumping rate.

Figure 17:
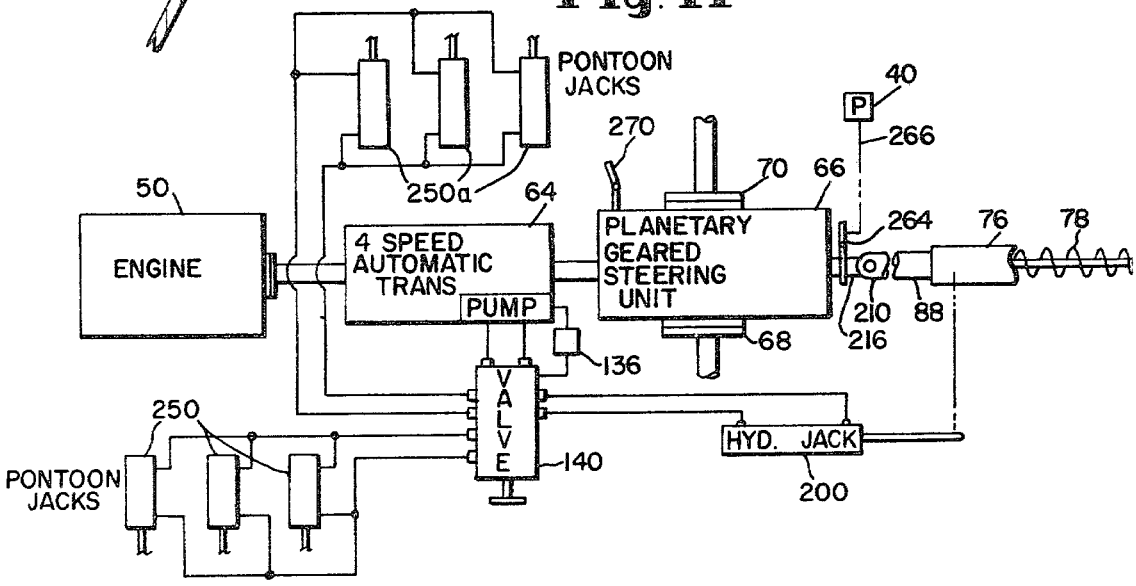
FIG. 17 is a generally schematic view of the power plant, drive train and hydraulic circuit for the embodiment illustrated in FIGS. 12–16.

In the embodiment shown in FIGS. 12–18, pump 40 may be drive connected to the vehicle's drive train 58 through any suitable supplemental drive train 262 (see FIG. 17). Drive train 262 may comprise a gear train 264 and drive shaft 266 interconnecting shaft 216 and the drive shaft of pump 40 itself. Alternatively, a separate variable speed drive and engine unit (not shown) may be provided for operating pump 40.

In the embodiment shown in FIGS. 12–18, the hydraulic pump 268 (FIG. 17) in the automatic transmission 64 may be used for operating the hydraulic jacks 200, 250, and **250*a*. To accomplish this, the main inlet and outlet ports of valve 140 are connected to the operating ports of pump 268, and the various hydraulic fluid operating ports of jacks 200, 250 and 250*a* are connected to separate operating ports of valve 140, all as shown in FIG. 17**.

From the foregoing description of the embodiment shown in FIGS. 12–18, it will be appreciated that the equipment is placed in operation by extending jack 200 through operation of valve 140 to swing the material extraction device 32 downwardly to its lowered, operating position where the exposed lead end of helix unit 78 and the forward end of casing 76 are buried in the sediment bed 28 in the manner illustrated in FIG. 8. Coupling pin 214 is inserted to selectively couple shaft 216 to shaft 210, and, with the steering control member 72 in neutral to hold clutches 68 and 70 disengaged, engine 50 is operated to drive helix unit 78 through the automatic transmission 64 and the geared steering unit 66. The rotational speed of shaft 216 and, consequently, helix unit 78 is variable by the manually adjustable speed control throttle 270 (FIG. 17) which unit 66 is equipped with and which is also used to control the speed of vehicle 30 when the vehicle is in operation. Throttle 270 is selectively set to a position for rotation helix unit 78 at a desired speed. It will be noted that once the throttle is set, the rotational speed of helix unit 78 remains the sme even though the automatic transmissin 64 shifts up or down to accommodate variations in loading.

Rotation of the helix unit 78 picks up and feeds the sediment through casing 76 and conduit 260 to pump 40 in a continuous stream. The sediment is then continuously transferred by pump 40, concomitantly with the extraction of the sediment, through pipeline portions 152' and 154 to the disposal site.

The inflatable pontoon assemblies 240 and 241 are normally retained in their raised inoperative positions. If it is desired to increase the stability and bouyancy of vehicle 30 selected ones of pontoon units 242–244 and **242*a*–244*a* may be swung downwardly to their illustrated operative positions where the pontoons float in the water. To accomplish this, valve 140 is operated to different position to extend the various hydraulic jacks 250 and 250*a*** dependng upon which pontoons the operator wishes to place in use.

Figure 18:
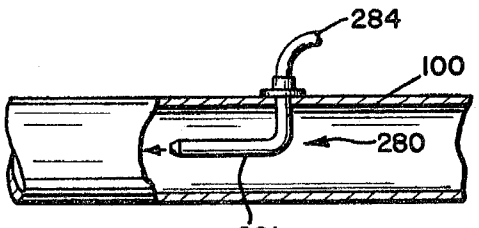
FIG. 18 is a section taken substantially along lines 18–18 of FIG. 12.

Referring to FIG. 18, the apparatus may further be equipped with a device 280 for reducing the back pressure acting on the extracted material passing through casing 76. In this embodiment, device 280 is located in the outlet pipe 100 just downstream from outlet port 104 and comprises a pitot-like tube 281 positioned in outlet pipe 100 to direct a jet of pressurized air in a downstream direction coaxial with the section of pipe in which it is located. Tube 281 may be supplied with air under pressure by an engine-driven air compressor 282 through a line or pipe 284.

Injection of pressurized air in outlet pipe 100 by tube 281 reduces the back pressure which is created by the sediment in outlet 100 and which acts on the sediment in casing 100. The pressurized air jet also increases the force acting to push the sediment toward pump 40. It will be appreciated that the use of tube 281 does not create a suction on the material lying in bed 28 in the region where it was picked up by helix unit 78. The pressurized air jet may further be regulated by a throttle valve 286 in line 284. Such regulation has the effect of selectively controlling to some extent the moisture content in the material being extracted by the extraction device 32. Reducing the back pressure by increasing the air jet pressure in outlet pipe 100 has the effect of increasing the moisture content and vise versa.

In addition to sediment, the apparatus shown in the illustrated embodiments is capable of extracting and transferring mud and any other flowable solid material as previously noted. The apparatus of this invention accomplishes this without removing any substantial quantity of water in the body of water overlying the bed. One measure which is indicative of the fact that the apparatus does not remove any substantial quantity of water is that the moisture in the removed material can be so controlled that the moisture content is approximately 10% or less by weight of the total weight of removed mass of solids and water.

Furthermore, the apparatus of this invention is capable of removing sediment or other flowable solid material from the bed in a pond or other body in which the pond is almost dry and virtually depleted of water. Such a condition arises sometimes in silts ponds.

In practice the exposed length of the lead end of helix 78 extending beyond casing 76 may be in the range extending from about 24" to about 29" for pitches in the range from about 3" to 8". The diameter of the helix 84 may be in the range from about 5½" to about 6" and the diameter of shaft 82 may be in the range from about 1" to about 2". The clearance 182 may be in the range from about 1/16" to about 3/16" for the values given above.

We claim:

1. A method of utilizing a material extraction device for extracting a flowable solid material from a bed underlying a body of water wherein said device comprises a rotatable auger-like helix or spiralled material pick-up unit positioned longitudinally in a casing and having an exposed material pick-up end portion projecting longitudinally beyond a forward open end of said casing, said method comprising the step of inserting said device endwise into said bed to a depth where said end portion and at least the forward end of said casing are buried in said bed, and rotating said auger-like unit (a) to engage and pick up the material in said bed at a region spaced below the surface of said bed and (b) to feed it through said casing to an outlet opening in said casing without cutting away the surface layer of said bed and without entraining the picked-up material in said body of water before the picked-up material enters said casing.

2. The method defined in claim 1 wherein said auger-like unit is radially supported in said casing by mechanical means only at a single location which is remote from said open forward end, said method further comprising the step of utilizing the picked-up material to provide an additional radial support for said auger-like unit in said casing to maintain said unit centered in said casing during operation.

3. An apparatus providing for the removal of flowable solid material, such as mud or sediment, in a bed underlying a body of water, said apparatus comprising a material extraction device including (a) a casing (b) a rotatably mounted shaft, and (c) a spiralled element mounted on said shaft for rotation therewith, the assembly of said shaft and said spiralled element being positioned in and extending longitudinally of said casing, said casing have a forward open end, said assembly of said shaft and said spiralled element extending through said open end and having an exposed lead end portion projecting forwardly beyond said casing for insertion into said bed, means mounting said material extraction device for selective displacement to an operational position where at least said lead end portion is buried in said bed and the rearward portion of said extraction device lies above said bed such that said extraction device extends endwise into said bed and projects upwardly from said bed at an angle thereto, and power means for rotating said assembly to provide for the extraction of said material from said bed at a region spaced below the surface of the bed and to further provide for the delivery of the extracted material through said casing to an outlet of said casing without cutting away the surface layer of said bed.

4. The apparatus defined in claim 3 wherein said means mounting said material extraction device comprises an amphibious vehicle adapted for travel on land and water.

5. The apparatus defined in claim 4 including pipeline means for conveying the material from said casing to a pre-selected location on land, said pipeline means having (a) a first portion positioned on land to discharge the material at said pre-selected location and (b) a second portion disposed intermediate said casing and said first portion, said second portion being flexible to permit said vehicle to be maneuvered about without disturbing the position of said first portion.

6. The apparatus defined in claim 5 including a gravity or pressure fed pump connected intermediate said first and second portions for pumping the extracted material through said first portion.

7. The apparatus defined in claim 5 including a power driven conveyor device positioned in said first portion for feeding the extracted material through said first portion.

8. The apparatus defined in claim 5 including a gravity or pressure feed pump positioned on said vehicle, said pipeline means including a third portion connected between the outlet of said casing and the inlet of said pump for conveying the extracted material from said casing to said pump, said second portion being connected between the outlet of said pump and said first portion, said pump being drivable to pump the extracted material through said first and second portions.

9. The apparatus defined in claim 4 wherein said vehicle has movable, ground and water engaging means for moving the vehicle on land and water, and wherein said power means comprises an engine positioned in said vehicle, there being a drive train selectively connectable to said movable means to provide for the power driven movement of the vehicle on land and water, said drive train having a rotatable, power driven shaft element, and there being means for selectively coupling said shaft element to the shaft on which said spiralled element is mounted for rotating said assembly of said shaft and said spiralled element by the power supplied from said engine.

10. The apparatus defined in claim 9 wherein said movable means comprises a pair of endless tracks positioned one on each side of the vehicle, and wherein said drive means includes a steering unit and an automatic transmission, said transmission being connected intermediate said steering unit and said engine, and said steering unit being connected through selectively operable clutches to said tracks, said shaft element being connected at an output of said steering unit to be driven by said engine through said transmission, and there being means for selectively controlling the rotational speed of said shaft element.

11. The apparatus defined in any one of the preceding claims 4–10 wherein said vehicle has a floatable hull, and wherein said extraction device is disposed forwardly of said hull and is supported from said hull for swinging movement about a horizontal axis.

12. The apparatus defined in any one of the preceding claims 4–10 including a support structure, said extraction device is mounted on said support structure for swingable movement about a horizontal axis, and said support structure being mounted on said vehicle for rotational movement about a vertical axis.

13. The apparatus defined in any one of the preceding claims 3–10 wherein the interior surface of said casing is cylindrically contoured and wherein said extraction device includes structural means radially supporting said assembly only at a location remote from said open end of said casing, said assembly being additionally supportably by the extracted material in the casing in centered relation thereto during operation of the material extraction device to locate the rotational axis of said assembly coaxially with respect to said casing.

14. The apparatus defined in any one of the preceding claims 3–10 including means for selectively varying the rotational speed of said assembly, there being a radial clearance between said spiralled element and the interior surface of said casing, and said clearance being sufficiently small to enable the moisture content in the extracted material to be controlled by selectively varying the rotational speed of said assembly.

15. The apparatus defined in any one of the preceding claims 3–10 wherein the forward end of said casing is also insertable into said bed upon displacement of said extraction device to said operational position, and wherein said forward end of said casing is outwardly flared to deflect water away from said open end.

16. The apparatus defined in any one of the preceding claims 3–10 including means for selectively varying the rotational speed of said assembly, there being a radial clearance between said spiralled element and the interior of said casing, said clearance being the only radial opening between the outer periphery of said shaft and the interior of said casing, and said clearance being suffifiently small that (a) said casing becomes completely filled with the extracted material during operation and (b) the moisture content in the extracted material is controllable by varying the rotational speed of said assembly.

17. The apparatus defined in claim 5 including means for supplying a jet of pressurized air in said pipeline means at or adjacent to said outlet of said casing on the downstream side thereof, the jet being directed downstream of said outlet of said casing to reduce the back pressure which is produced by material passing through said pipeline means and acting on the extracted material in said casing to resist the movement of the material through said casing.

18. The apparatus defined in claim 4 wherein said vehicle is equipped with a pair of pontoon assemblies, said pontoon assemblies being disposed one on each side of the vehicle and each comprising pontoon means support on said vehicle for swinging movement about a horizontal axis extending longitudinally of said vehicle, and means for selectively swinging said pontoon means between a raised position where said pontoon means is lifted out of the water and a lowered position where the pontoon means rests in the water to increase the bouyancy and stability of the vehicle in the water.

* * * * *

UNITED STATES PATENT AND TRADEMARK OFFICE

CERTIFICATE OF CORRECTION

PATENT NO. : 4,312,762

DATED : January 26, 1982

INVENTOR(S) : Curtis D. Blackburn, Randall L. Blackburn & Dewey L. Adkins

It is certified that error appears in the above-identified patent and that said Letters Patent are hereby corrected as shown below:

Column 2, line 67 change "required" to --require--.

Column 4, line 39 change "expecially" to especially--.

Column 6, line 41 change "foot" to --feet--.

Column 10, line 51 place a space between "thenose".

Column 16, line 41, change "sme" to --same--.

Column 16, line 65 change "pitot-like" to --pivot-like--.

Column 17, line 34 change "silts" to --silt--.

Column 18, line 9 change "have" to --having--. (Mistake made in retyping original claim 16).

Column 19, line 31 change "supportably" to --supported--. (Obvious spelling error)

Column 20, line 16 change "suffifiently" to --sufficiently--

Signed and Sealed this

*Twenty-fifth* Day of *May 1982*

[SEAL]

*Attest:*

GERALD J. MOSSINGHOFF

*Attesting Officer*

*Commissioner of Patents and Trademarks*